US006233899B1

(12) United States Patent
Mellert et al.

(10) Patent No.: US 6,233,899 B1
(45) Date of Patent: May 22, 2001

(54) APPARATUS AND METHODS FOR INSTALLING TONGUE-AND-GROOVE MATERIALS

(75) Inventors: Richard D. Mellert, Eugene, OR (US); David N. Nystrom, P.O. Box 41975, Eugene, OR (US) 97404

(73) Assignee: David N. Nystrom, Eugene, OR (US)

( * ) Notice: Subject to any disclaimer, the term of this patent is extended or adjusted under 35 U.S.C. 154(b) by 0 days.

(21) Appl. No.: 09/316,437

(22) Filed: May 21, 1999

(51) Int. Cl.[7] ..... B66F 3/00; E04F 21/22

(52) U.S. Cl. ..... 52/747.1; 52/749.1; 52/DIG. 1; 254/11; 254/15; 254/17; 269/904

(58) Field of Search ..... 52/DIG. 1, 749.1, 52/749.11, 747.1, 747.11, 745.13; 254/11, 15, 16, 17, 131; 269/904

(56) References Cited

U.S. PATENT DOCUMENTS

| | | | | |
|---|---|---|---|---|
| 342,529 | * | 5/1886 | McRae | 254/15 X |
| 353,726 | * | 12/1886 | Wilber | 254/15 |
| 371,169 | * | 10/1887 | Brown et al. | 254/15 |
| 785,491 | * | 3/1905 | Holcombe | 254/15 |
| 832,516 | * | 10/1906 | Williams | 254/17 |
| 1,242,623 | * | 10/1917 | West | 254/17 |
| 1,918,017 | * | 7/1933 | Christ | 254/16 |
| 2,546,294 | * | 3/1951 | Blomstrom | 254/16 |
| 2,624,544 | * | 1/1953 | Graham | 254/15 |
| 2,864,581 | * | 12/1958 | Harrison | 254/15 |
| 4,821,784 | * | 4/1989 | Cone | 254/17 X |
| 5,269,494 | * | 12/1993 | Pittman, et al. | 254/17 |
| 5,478,050 | * | 12/1995 | Ott | 254/17 |
| 5,826,858 | * | 10/1998 | Gordon | 254/17 |

FOREIGN PATENT DOCUMENTS

| | | | | |
|---|---|---|---|---|
| 835524 | * | 4/1952 | (DE) | 254/15 |
| 932305 | * | 7/1963 | (GB) | 254/17 |

* cited by examiner

*Primary Examiner*—Laura A. Callo
(74) *Attorney, Agent, or Firm*—David S. Alavi

(57) ABSTRACT

A method for installing tongue-and-groove material comprises the steps of: a) placing a piece of tongue-and-groove material on an installation surface adjacent to a previously installed piece of tongue-and-groove material and/or a border member; b) pivotably securing a lever having a thrust portion and a lever end to the installation surface so that rotating the lever urges the piece of tongue-and-groove material against the previously installed piece and/or the border member; c) rotating the lever, thereby urging the piece of tongue-and-groove material against the previously installed piece and/or the border member; d) securing the piece of tongue-and-groove material to the previously installed piece, the border member, and/or the installation surface; and e) removing the lever from the installation surface.

An apparatus for installing tongue-and-groove material comprises a lever having a thrust portion and a lever end, wherein the lever is adapted to be pivotably secured to an installation surface so that rotating the lever urges a piece of tongue-and-groove material against a previously installed piece of tongue-and-groove material and/or a border member, and then removed from the installation surface after the piece of tongue-and-groove material has been secured to the previously installed piece, the border member, and/or the installation surface. The apparatus may further comprise a pushing member employed between the thrust portion and the piece of tongue-and-groove material, so that rotating the lever urges the pushing member against the piece of tongue-and-groove material, thereby urging the piece of tongue-and-groove material against the previously installed piece and/or the border member.

16 Claims, 8 Drawing Sheets

APPARATUS AND METHODS FOR INSTALLING TONGUE-AND-GROOVE MATERIALS

FIELD OF THE INVENTION

The field of the present invention relates to tongue-and-groove materials. In particular, apparatus and methods are described herein for installing tongue-and-groove materials.

BACKGROUND

Tongue-and-groove materials find many and varied uses in building construction. They may be employed as flooring and/or sub-flooring, under-layment, siding, wall material, ceiling material, roofing material, and so forth. The firm engagement of adjacent pieces of tongue-and-groove material along substantially the entire length of their common edges yields a structurally sound continuous installed surface. This feature is especially important for siding and roofing materials where the tongue-and-groove material is often utilized to form a weather barrier, and for flooring where the tongue-and-groove material must bear substantial loads. It is therefore quite important that adjacent pieces of tongue-and-groove materials be fully and properly engaged when they are installed.

As tongue-and-groove materials are installed, it is therefore necessary to apply substantial force to completely insert the tongue of one piece of tongue-and-groove material into the groove of an adjacent piece, and to apply that force over substantially the entire length of the pieces. This force is frequently applied as a series of abrupt impacts, accomplished by hitting or tapping a piece of tongue-and-groove material with a hammer or similar tool, sometimes with an intervening block or pull-bar. While often effective, this common method of installation has significant drawbacks. The series of impacts along the length of a piece of tongue-and-groove material being installed, while engaging the segment of the piece in the immediate area of the impact, will often also jar other segments of the piece or adjacent pieces loose. This results in a slow and tedious installation process, wherein the same segments and pieces of tongue-and-groove material must be hit and re-hit many times until one happens to get everything "just right". This is a particularly vexing problem with tongue-and-groove flooring materials, including laminate flooring materials, which must be glued together as they are installed. With laminate flooring materials, it is absolutely essential for proper performance of the installed floor that the pieces of flooring be evenly forced together and firmly held as the glue sets or cures, thereby yielding a continuous glue seal along the entire edge of each piece of flooring. The constant jostling of pieces that results from repeated hammer blows renders this procedure quite difficult.

Another obvious drawback of such a method is the damage to the tongue-and-groove material that can and does frequently occur as it is repeatedly whacked with a hammer, even when an intervening block or pull-bar is used. The tongues and/or grooves may be damaged, disturbing the structural integrity of the finished area of installed tongue-and-groove material and/or the sealed edges desired upon installation. Damage to the exposed surface of the material may also result from repeated impacts during installation, resulting in cosmetic damage to the finished installed surface and/or reduced useful life of the installed surface.

It is therefore desirable to provide methods and apparatus for installing tongue-and-groove materials which avoid these drawbacks of current installation apparatus and methods.

SUMMARY

Certain aspects of the present invention may overcome one or more aforementioned drawbacks of the previous art and/or advance the state-of-the-art of apparatus and methods for installing tongue-and-groove material, and in addition may meet one or more of the following objects:

- To provide apparatus and methods for installing tongue-and-groove material wherein adjacent pieces of tongue-and-groove material are forced together without abrupt impacts;
- To provide apparatus and methods for installing tongue-and-groove material wherein a piece of tongue-and-groove material need not be repeatedly forced into place;
- To provide apparatus and methods for installing tongue-and-groove material wherein the tongue-and-groove material may be readily and rapidly installed;
- To provide apparatus and methods for installing tongue-and-groove material wherein the likelihood of damage to the tongue-and-groove material during installation is reduced or eliminated;
- To provide apparatus and methods for installing tongue-and-groove material wherein a lever may be pivotably secured to an installation surface and used to urge a piece of tongue-and-groove material being installed against an adjacent piece of previously installed tongue-and-groove material;
- To provide apparatus and methods for installing tongue-and-groove material wherein a cam lever may be pivotably secured to an installation surface and used to urge a piece of tongue-and-groove material being installed against an adjacent piece of previously installed tongue-and-groove material;
- To provide apparatus and methods for installing tongue-and-groove material wherein a pushing member may be employed between a lever and a piece of tongue-and-groove material being installed;
- To provide apparatus and methods for installing tongue-and-groove material wherein a pushing member may be employed between a cam lever and a piece of tongue-and-groove material being installed;
- To provide apparatus and methods for installing tongue-and-groove material wherein the lever and/or pushing member may be secured to the installation surface to hold a piece of tongue-and-groove material in place during installation; and
- To provide apparatus and methods for installing tongue-and-groove material wherein the cam lever and/or pushing member may be secured to the installation surface to hold a piece of tongue-and-groove material in place during installation.

One or more of the foregoing objects may be achieved in the present invention by a method for installing tongue-and-groove material, comprising the steps of: a) placing a piece of tongue-and-groove material on an installation surface adjacent to a previously installed piece of tongue-and-groove material and/or a border member; b) pivotably securing a lever or cam lever to the surface so that rotating the lever or cam lever urges the piece of tongue-and-groove material against the previously installed piece and/or the border member; c) rotating the lever or cam lever, thereby urging the piece of tongue-and-groove material against the previously installed piece and/or the border member; d) securing the piece of tongue-and-groove material to the previously installed piece, the border member, and/or the installation surface; and e) removing the lever or cam lever from the installation surface.

One or more of the foregoing objects may be achieved in the present invention by an apparatus for installing tongue-and-groove material, comprising a lever having a thrust portion and a lever end, wherein the lever is adapted to be pivotably secured to an installation surface so that rotating the lever urges a piece of tongue-and-groove material against a previously installed piece of tongue-and-groove material and/or a border member, and then removed from the installation surface after the piece of tongue-and-groove material has been secured to the previously installed piece, the border member, and/or the installation surface. The apparatus may further comprise a pushing member employed between the thrust portion of the lever and the piece of tongue-and-groove material, so that rotating the lever urges the pushing member against the piece of tongue-and-groove material, thereby urging the piece of tongue-and-groove material against the previously installed piece and/or the border member. The lever and/or pushing member may be secured to the installation surface to hold the piece of tongue-and-groove material in place while it is secured to the previously installed piece, the border member, and/or the installation surface.

One or more of the foregoing objects may be achieved in the present invention by an apparatus for installing tongue-and-groove material, comprising a cam lever having a cam end and a lever end, wherein the cam end is adapted to be pivotably secured to an installation surface so that rotating the cam lever urges a piece of tongue-and-groove material against a previously installed piece of tongue-and-groove material and/or a border member, and then removed from the installation surface after the piece of tongue-and-groove material has been secured to the previously installed piece, the border member, and/or the installation surface. The apparatus may further comprise a pushing member employed between the cam end of the cam lever and the piece of tongue-and-groove material, so that rotating the cam lever urges the pushing member against the piece of tongue-and-groove material, thereby urging the piece of tongue-and-groove material against the previously installed piece and/or the border member. The cam lever and/or pushing member may be secured to the installation surface to hold the piece of tongue-and-groove material in place while it is secured to the previously installed piece, the border member, and/or the installation surface.

The apparatus and methods disclosed and/or claimed herein according to the present invention avoid the drawbacks and limitations of current apparatus and methods for installing tongue-and-groove materials. The lever action of the lever and/or the cam action of the cam lever slowly and steadily applies a substantial force to the piece of tongue-and-groove material being installed without any abrupt impact. Jostling and/or disturbing previously installed segments of the piece or other previously installed pieces is thereby avoided, and the overall installation process may proceed quite rapidly. Elimination of impacts on the tongue-and-groove material also reduces or eliminates the prospect of damage to the tongue-and-groove material during installation and/or deleterious sequelae thereof. Use of the lever, cam lever, and/or the pushing member to hold the piece of tongue-and-groove material being installed allows it to be secured without disturbing its carefully achieved position. Fasteners may be applied, or glue allowed to set or cure, while the piece of tongue-and-groove material is firmly held in place.

Additional objects and advantages of the present invention may become apparent upon referring to the preferred and/or alternative embodiments of the present invention as illustrated in the drawings and described in the following written description and/or claims.

DETAILED DESCRIPTION OF PREFERRED AND ALTERNATIVE EMBODIMENTS

For purposes of the present written description and/or claims, the term"tongue-and-groove material" shall denote any material intended to cover an area but supplied in pieces smaller than the area to be covered, and wherein the pieces are provided with edges adapted to engage adjacent pieces. The edges are in the form of"tongues" (protruding portions of the material extending along one or more edges) and-"grooves" (recessed portions of the material extending along one or more edges). When the tongue-and-groove material is installed, a tongue of a piece of the material is received within a groove of an adjacent piece of the material, thereby engaging the pieces of tongue-and-groove material. Examples of tongue-and-groove materials may include, but are not limited to: laminate flooring, wood flooring, other flooring materials, siding, sub-floor, under-layment, framing, stonework, concrete, tile, ceiling material, roofing material, and so forth. The present invention may be generally applicable to a broader range of materials supplied in pieces having edges adapted to interlock with the edges of adjacent pieces. Pieces of such interlocking materials typically are provided with edges having complementary profiles (viewed from above and/or in cross-section) so that the adjacent pieces fit together.

For purposes of the present written description and/or claims, the term"installation surface" shall denote any surface on which the tongue-and-groove material is to be installed. The installation surface may comprise a continuous surface (such as a sub-floor, for example, on which tongue-and-groove flooring material may be installed), or may comprise one or more frame members that together define a surface (a set of wall studs, for example, on which tongue-and-groove siding material may be installed). For purposes of the present written description and/or claims, the term"border member" shall denote any spacer, adjacent surface, wall, floor, ceiling, framing members, and the like, that may be located near or adjacent to the installation surface, so that tongue-and-groove material installed on the installation surface may come into contact therewith.

Figure 1:
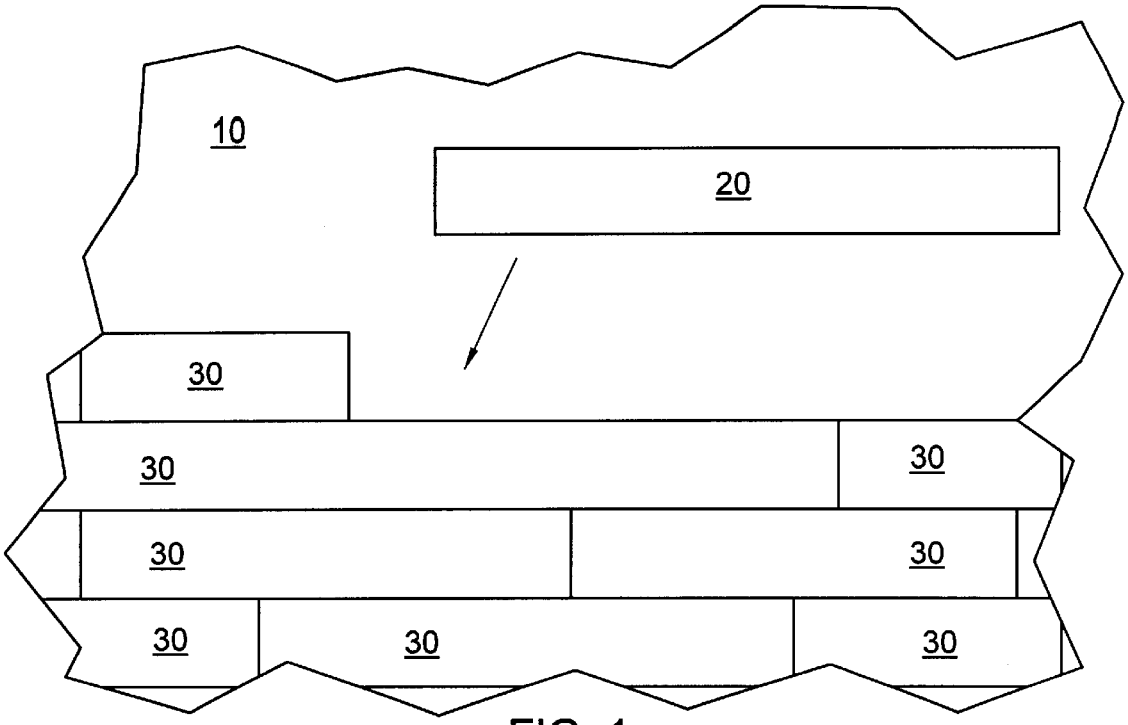
FIGS. 1, 2, 3, and 4 show a top view of an apparatus for installing tongue-and-groove materials as it is used to install a piece of tongue-and-groove material according to the present invention.
Figure 2:
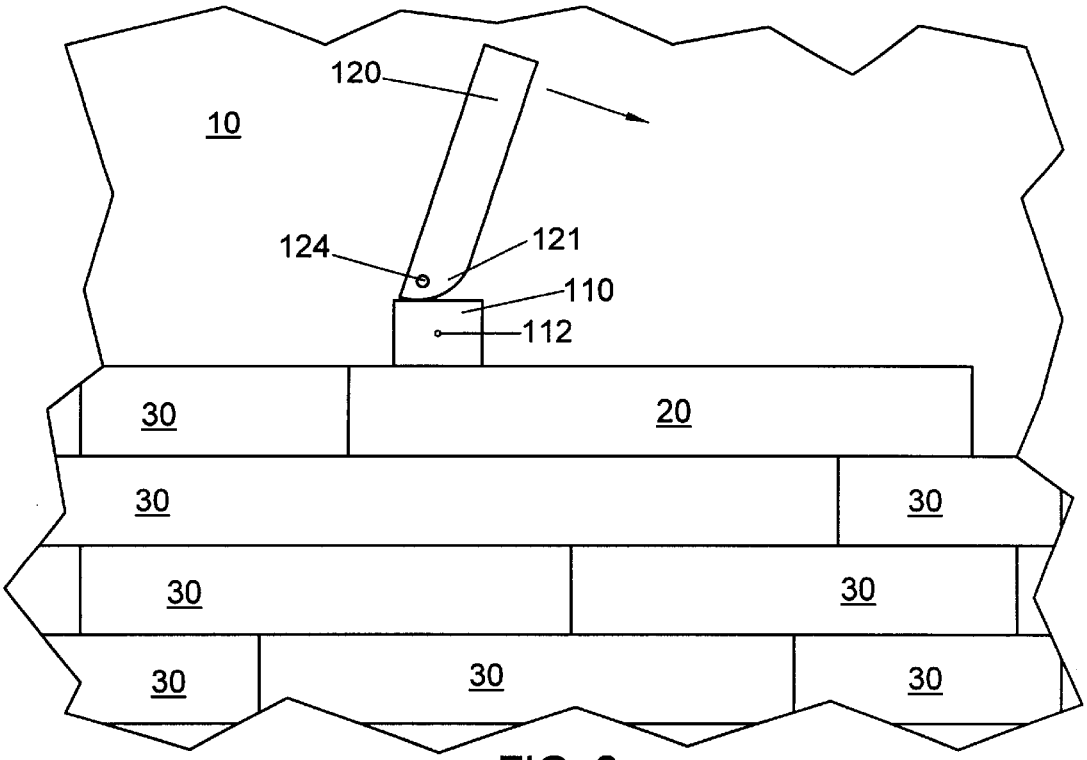
Figure 3:
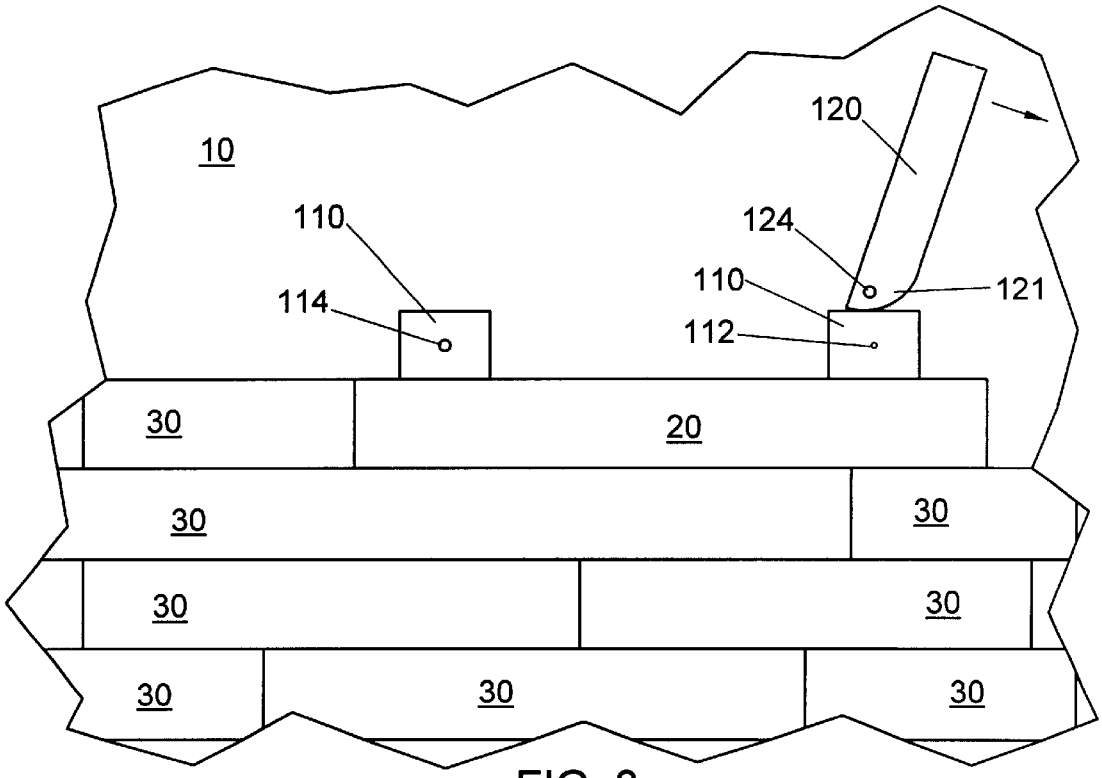
Figure 4:
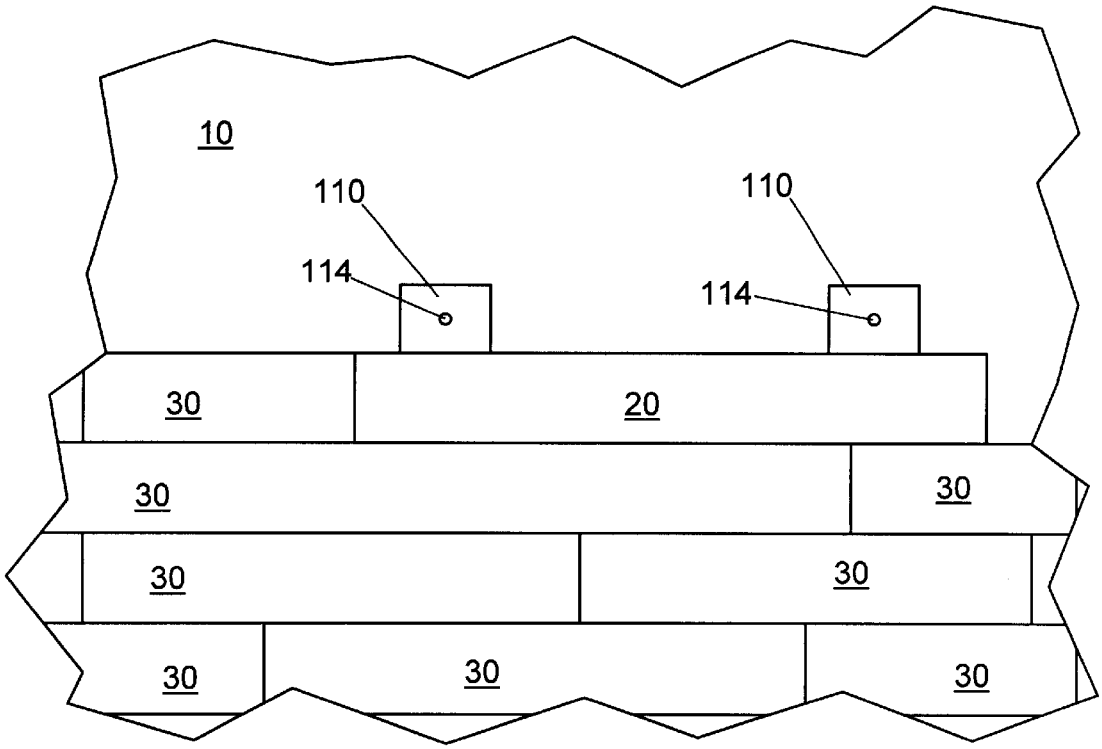

FIGS. 1 through 7 illustrate a preferred method for installing tongue-and-groove material according to the present invention, using a preferred embodiment of an apparatus for installing tongue-and-groove material according to the present invention. Previously installed pieces 30 of tongue-and-groove material are shown installed on installation surface 10. Piece 20 of tongue-and-groove material to be next installed is shown in FIG. 1 on installation surface 10 before being placed in position against pieces 30. In FIG. 2, piece 20 has been placed in the desired installation position engaged with pieces 30. Pushing member 110 has been placed against piece 20, and lever 120, having a thrust portion comprising cam end 121, has been pivotably secured to installation surface 10 with pivot member 124. Lever 120 is then rotated in the direction of the arrow, thereby urging pushing member 110 against piece 20, which is in turn urged against and engaged with one or more of pieces 30. The rotation of lever 120 may serve to urge piece 20 transversely and/or longitudinally. Pushing member 110 may be secured to installation surface 10 by securing member 114 received though hole 112 so as to continue urging piece 20 against piece(s) 30 after removal of pivot member 124 and lever 120, as shown in FIG. 3. A second pushing member 110 may be similarly urged against piece 20 by lever 120 as shown in FIG. 3, and may be similarly secured to installation surface 10 by a second securing member 114. In FIG. 4, piece 20 is shown engaged with piece(s) 30 and urged against piece(s) 30 by pushing members 110 secured to installation surface 10 by securing members 114. One or more pushing members 110 may remain in place secured to installation surface 10 until piece 20 is secured in place, to at least one of installation surface 10, piece(s) 30, and a border member (not shown). After piece 20 has been secured, pushing members 110 may be removed.

Figure 5:
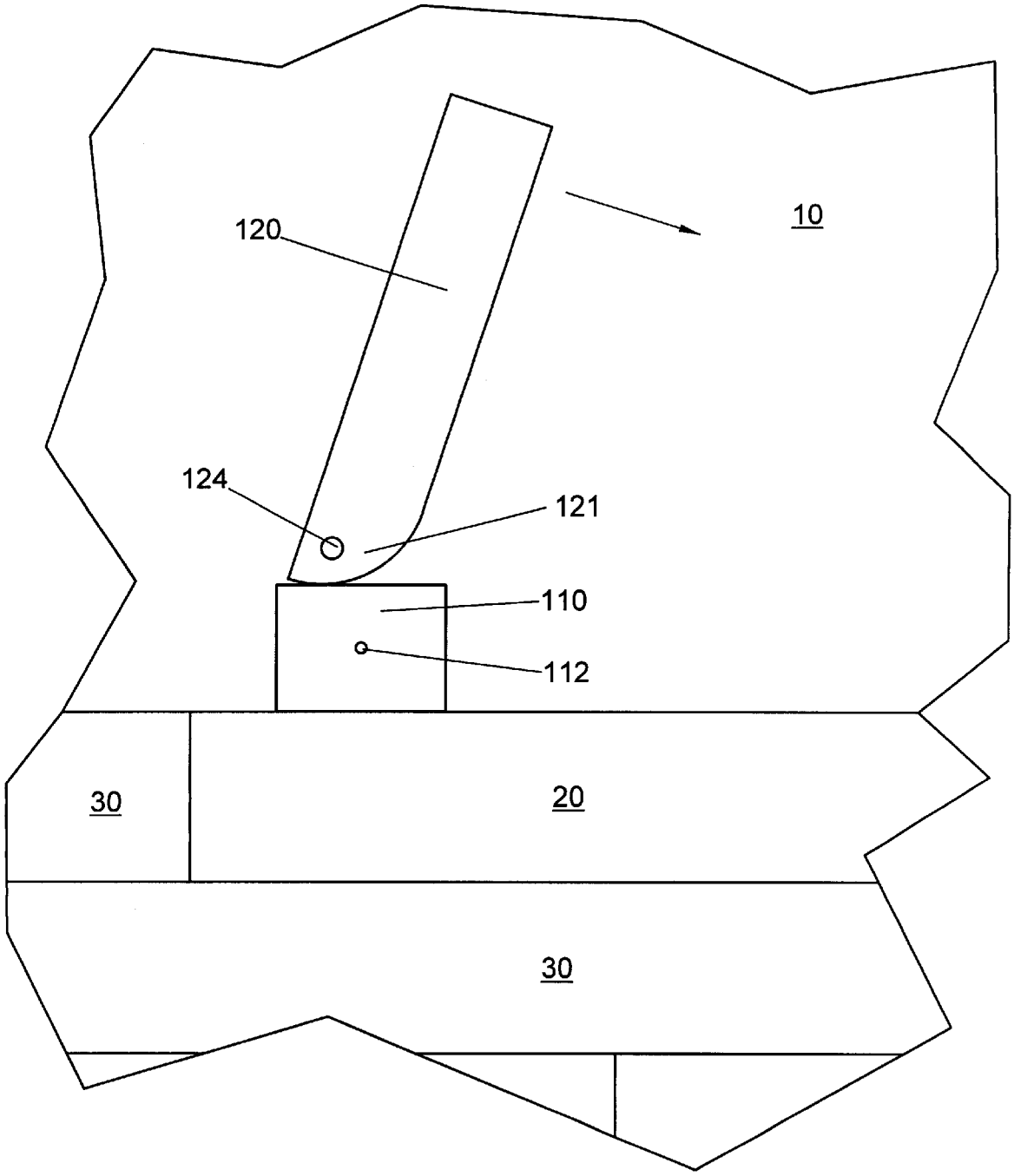
FIG. 5 shows an enlarged top view of an apparatus for installing tongue-and-groove materials as it is used to install a piece of tongue-and-groove material according to the present invention.
Figure 6:
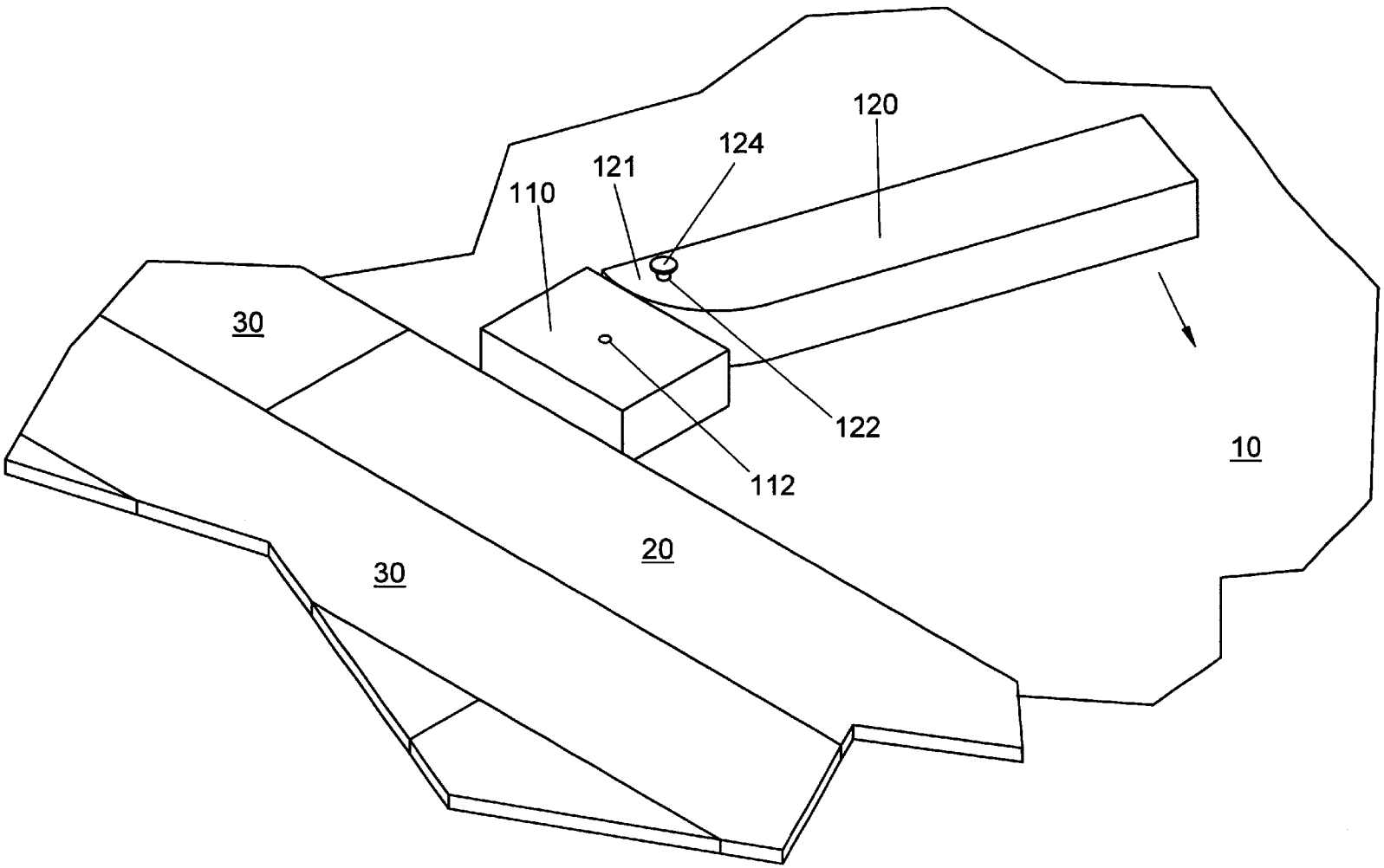
FIGS. 6 and 7 show perspective views of an apparatus for installing tongue-and-groove materials as it is used to install a piece of tongue-and-groove material according to the present invention.
Figure 7:
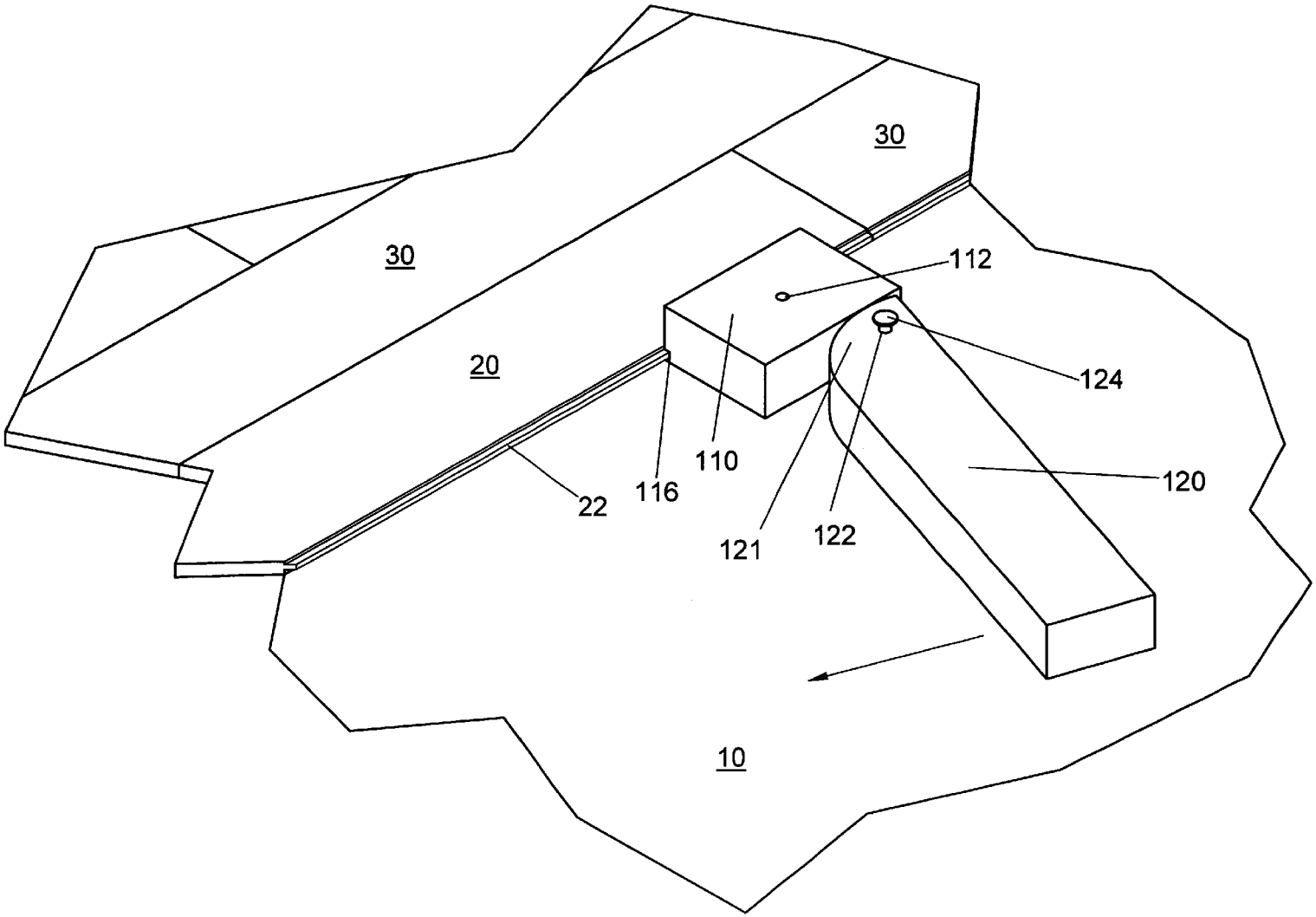

FIGS. 5 through 7 show the operation of lever 120 and pushing member 110 in greater detail. Cam end 121 of lever 120 is provided with a hole 122 therethrough. Pivot member 124 may pass therethrough to pivotably secure lever 120 to installation surface 10 so that rotating lever 120 (in the direction of the arrow) urges pushing member 110 against piece 20, and in turn urges piece 20 against one or more of pieces 30. Pivot member may preferably comprise a nail passing through hole 122 and driven into installation surface 10. Without departing from inventive concepts disclosed and/or claimed herein, various pivot members may be employed for pivotably securing lever 120 to installation surface 10, including as examples but not limited to nail, double-headed nail, screw, bolt, spike, pin, dowel, and so forth, and the pivot member may be integral to the lever or may be a separate component. FIG. 7 further shows pushing member 110 adapted to engaged piece 20. Preferably, pushing member 110 may be provided with groove 116 for receiving tongue 22 of piece 20. Securing member 114 (not shown in FIGS. 5 through 7) may preferably comprise a nail passing through hole 112 and driven into installation surface 10.

Figure 8A:
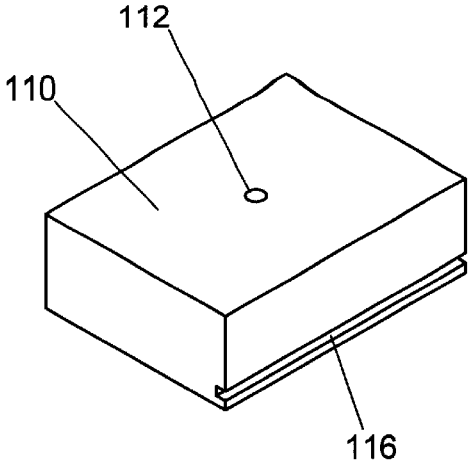
FIGS. 8A and 8B show perspective views of alternative embodiments of a pushing member of an apparatus for installing tongue-and-groove materials according to the present invention.
Figure 8B:
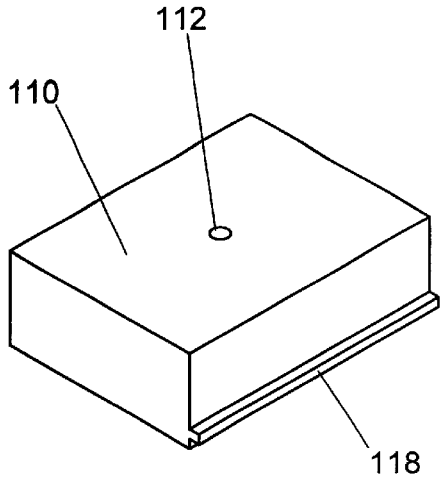

FIGS. 8A and 8B show two embodiments of pushing member 110 adapted to engage piece 20. FIG. 8A shows pushing member 110 with groove 116 for receiving a tongue of piece 20 of the tongue-and-groove material being installed. FIG. 8B shows pushing member 110 with a tongue 118 for engaging a groove of piece 20 of the tongue-and-groove material. A single pushing member may be provided with both a tongue and a groove. The depth of groove 116 may be sufficiently shallow so that the force applied by pushing member 110 on piece 20 may be borne by the tongue of piece 20, sufficiently deep so that the force may be borne by the edges of the top and bottom surfaces of piece 20, or preferably of an appropriate intermediate depth so that the force may be borne by the edges of the top and bottom surfaces as well as the tongue of piece 20. The length of tongue 118 may be sufficiently long so that the force applied by pushing member 110 on piece 20 may be borne by the groove of piece 20, sufficiently short so that the force may be borne by the edges of the top and bottom surfaces of piece 20, or preferably of an appropriate intermediate length so that the force may be borne by the edges of the top and bottom surfaces as well as the groove of piece 20. Various securing members may be employed for securing pushing member 110 to installation surface 10, including as examples but not limited to: nail, double-headed nail, screw, bolt, pin, spike, dowel, clamp, weights, shims, wedges, and so forth, and the securing member may be integral to the pushing member or may be a separate component.

Figure 10:
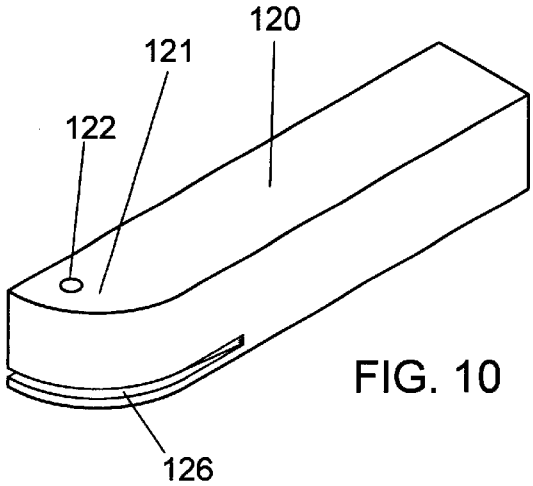
FIG. 10 shows a perspective view of an alternative embodiment of a lever of an apparatus for installing tongue-and-groove material according to the present invention.
Figure 9A:
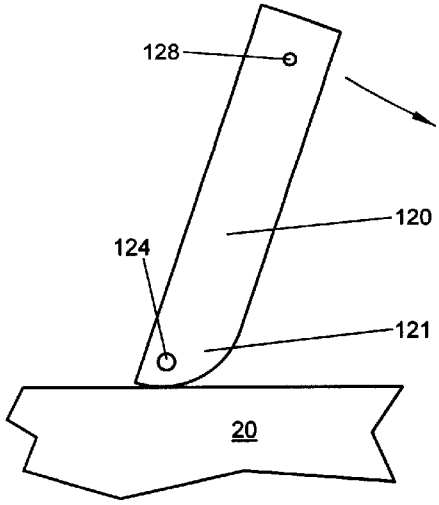
FIGS. 9A, 9B, 9C, and 9D show top views of alternative embodiments of a lever of an apparatus for installing tongue-and-groove material according to the present invention.
Figure 9B:
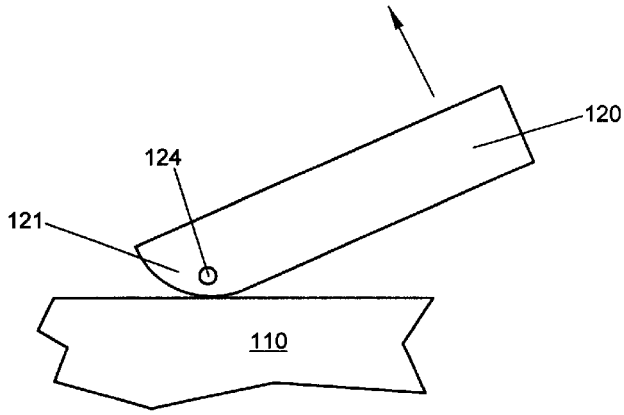
Figure 9C:
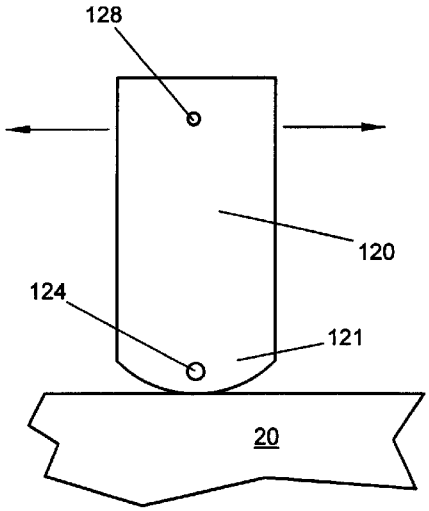
Figure 9D:
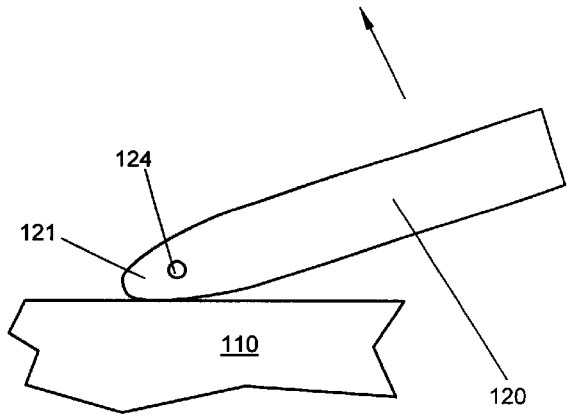

Without departing from inventive concepts disclosed and/or claimed herein, one or more levers 120 may be employed for installing the tongue-and-groove material without using pushing members 110. In this case cam end 121 of lever 120 may directly engage piece 20. Rotating lever 120 thereby urges piece 20 against one or more of pieces 30 (transversely and/or longitudinally), and lever 120 may be substantially non-pivotably secured to and may remain substantially non-pivotably secured to installation surface IO until piece 20 is secured in place, to at least one of installation surface 10, piece(s) 30, and a border member (not shown). After piece 20 has been secured, lever 120 may be removed. FIGS. 9A through 9D show alternative embodiments of lever 120 with cam end 121 adapted to be pivotably secured to installation surface 10 so that rotating the cam lever urges piece 20, either directly (FIGS. 9A and 9C) or with pushing member 110 (FIGS. 9B and 9D), against one or more of pieces 30 or a border member, and then removed from installation surface 10 after piece 20 has been secured to at least one of piece(s) 30, the border member, and installation surface 10. Each of the alternative embodiments of FIGS. 9A through 9D may be used with or without pushing member 110. When used without pushing member 110, lever 120 may be provided with hole 128 therethrough, and a securing member may pass therethrough to substantially non-pivotably secure lever 120 to installation surface 10. Each of the alternative embodiments of FIGS. 9A through 9D may be used with or without a securing member. The securing member may preferably take the form of a nail passing through hole 128 and driven into installation surface 10, thereby substantially nonpivotably securing lever 120 to installation surface 10. Various securing members may be employed for substantially non-pivotably securing lever 120 to installation surface 10, including as examples but not limited to: nail, double-headed nail, screw, bolt, pin, spike, dowel, clamp, weights, shims, wedges, and so forth, and the securing member may be integral to the lever or may be a separate component. Alternatively, pivot member 124 may be adapted to also function as securing member 128. Without departing from inventive concepts disclosed and/or claimed herein, any suitable shape of cam end 121 of lever 120 and placement of pivot member 124 may be employed which allows lever 120 to be used to urge piece 20 against one or more of pieces 30 (transversely and/or longitudinally) when pivotably secured to installation surface 10 (with or without an intervening pushing member 110). FIG. 10 shows lever 120 having a groove 126 on cam end 121 for engaging a tongue of piece 20 when used without pushing member 110. Alternatively, lever 120 may be provided with a tongue on cam end 121 for engaging a groove of piece 20 when used without pushing member 110. A lever according to the present invention, such as those shown in FIGS. 9A through 9D, may also be employed with a pull-bar for engaging piece 20.

Figure 11A:
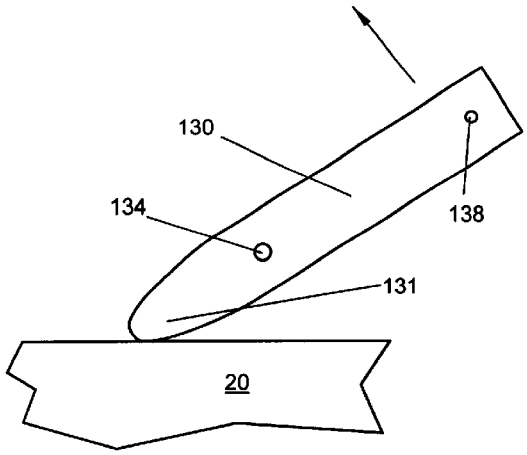
FIGS. 11A, 11B, 11C, 11D, and 11E show top views of alternative embodiments of a lever of an apparatus for installing tongue-and-groove material according to the present invention.
Figure 11B:
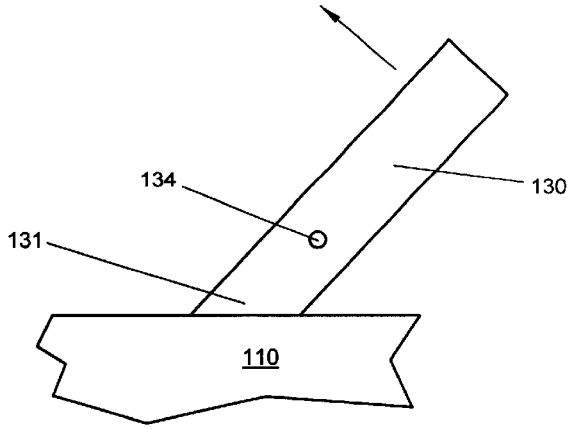
Figure 11C:
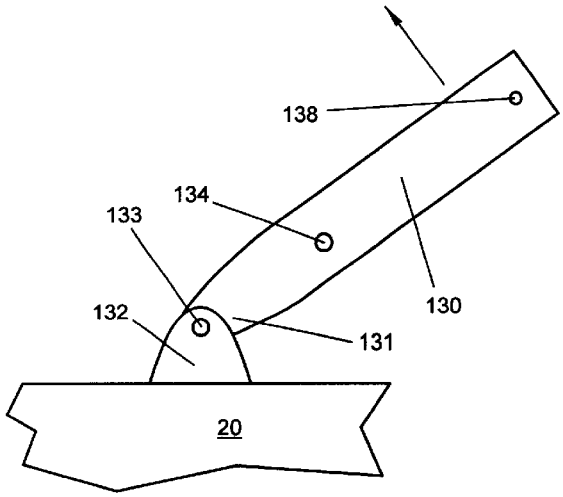
Figure 11D:
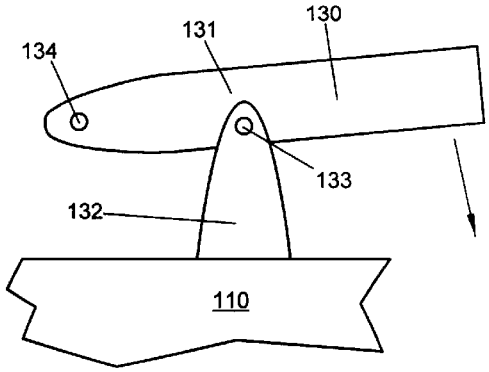
Figure 11E:
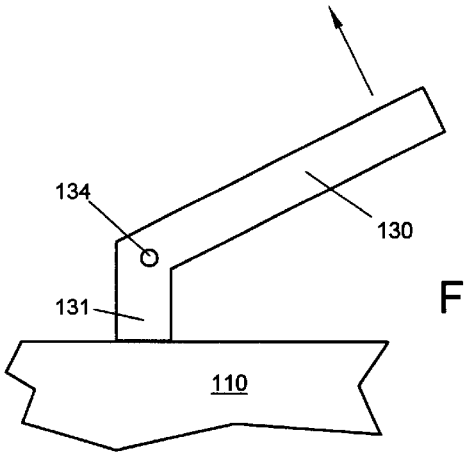

FIGS. 11A through 11E show alternative embodiments of a lever 130, having thrust portion 131 and being adapted to be pivotably secured to installation surface 10 by pivot member 134 so that rotating lever 130 urges piece 20, either directly (FIGS. 11A and 11C) or with pushing member 110 (FIGS. 11B, 11D, and 11E), against one or more of pieces 30 or a border member, and then removed from installation surface 10 after piece 20 has been secured to at least one of piece(s) 30, the border member, and installation surface 10. Without departing from inventive concepts disclosed and/or claimed herein, various pivot members may be employed for pivotably securing lever 130 to installation surface 10, including as examples but not limited to: nail, double-headed nail, screw, bolt, spike, pin, dowel, and so forth, and the pivot member may be integral to the lever or may be a separate component. Each of the alternative embodiments of FIGS. 11A through 11E may be used with or without pushing member 110. When used without pushing member 110, lever 130 may be provided with hole 138 therethrough, and a securing member may pass therethrough to substantially non-pivotably secure lever 130 to installation surface 10. Various securing members may be employed for securing lever 130 to installation surface 10, including as examples but not limited to: nail, double-headed nail, screw, bolt, pin, spike, dowel, clamp, weights, shims, wedges, and so forth, and the securing member may be integral to the lever or may be a separate component. Alternatively, pivot member 134 may also serve as securing member 138. Each of the alternative embodiments of FIGS. 11A through 11E may be used with or without securing member 138. Without departing from inventive concepts disclosed and/or claimed herein, any of a variety of suitable shapes and/or configurations of thrust portion 131 of lever 130 and placement of pivot member 134 may be employed which allows lever 130 to be used to urge piece 20 against one or more of pieces 30 (transversely and/or longitudinally) when pivotably secured to installation surface 10 (with or without an intervening pushing member 110). FIGS. 11C and 11D illustrate thrust portion 131 provided with a swivel member 132. As swivel member 132 swivels about swivel point 133, full engagement of swivel member 132 with pushing member 110 or piece 20 is maintained as lever 130 is rotated.

The specific steps involved in securing piece 20 while held in place by one or more pushing members 110, cam levers 120, and/or levers 130 depends on the nature of the tongue-and-groove material. For example, piece 20 may be secured to installation surface 10, to adjacent pieces 30, to surrounding border members, or to a combination thereof. Piece 20 may be secured using fasteners (nails, tacks, staples, screws, bolts, rivets, spikes, pegs, dowels, as so forth). In this case pushing members 110 secured to installation surface 10 may serve to immobilize piece 20 while the fasteners are applied (hammering nails, driving screws, drilling holes, etc.), which might otherwise cause piece 20 to shift. Alternatively, piece 20 may be secured using adhesives. Pushing members 110, cam levers 120 and/or levers 130 secured to installation surface 10 may serve to maintain the position of and pressure on piece 20 while an adhesive sets or cures, or may serve to apply pressure to activate a pressure-sensitive adhesive.

The use of cam lever 120 or lever 130 results in gradual application of force urging piece 20 against piece(s) 30. The gradual application of force on a segment of piece 20, as opposed to an abrupt impact, smoothly forces piece 20 into place without jarring other segments and/or pieces of tongue-and-groove material out of place. The installation procedure therefore proceeds more quickly, since segments/pieces need not be repeatedly forced into place after being jarred out of place by a subsequent impact. The absence of impacts also reduces the likelihood of damage to the tongue-and-groove material.

Cam lever 120, lever 130, and/or pushing member 110 may preferably be fabricated from a high quality dense plastic material. Without departing from inventive concepts disclosed and/or claimed herein, any sufficiently rigid material or combination of materials may be employed for fabricating cam lever 120, lever 130, and/or pushing member 110, including as examples but not limited to plastics, resins, wood (including solid wood, plywood, pressed board, particle board, and the like), metal, composite materials, fiberglass, polymeric materials, combinations thereof, and/or functional equivalents thereof.

The present invention has been set forth in the forms of its preferred and alternative embodiments. It is nevertheless intended that modifications to the disclosed apparatus and methods for installing tongue-and-groove materials may be made without departing from inventive concepts disclosed and/or claimed herein.

What is claimed is:

1. A method for installing tongue-and-groove material comprising the steps of:

a) placing a first piece of tongue-and-groove material on an installation surface on which the tongue-and-groove material is to be installed adjacent to at least one of a previously installed piece of tongue-and-groove material and a border member;

b) pivotably securing a lever, the lever having a thrust portion and a lever end, to the installation surface so that rotating the lever urges the first piece of tongue-and-groove material against at least one of the previously installed piece of tongue-and-groove material and the border member;

c) rotating the lever, thereby urging the first piece of tongue-and-groove material against at least one of the previously installed piece of tongue-and-groove material and the border member;

d) non-pivotably securing the lever to the installation surface by passing a securing member through a hole through the lever and into the installation surface, thereby continuing to urge the first piece of tongue-and-groove material against at least one of the previously installed piece of tongue-and-groove material and the border member;

e) securing the first piece of tongue-and-groove material to at least one of the previously installed piece of tongue-and-groove material, the border member, and the installation surface; and f) removing the lever from the installation surface.

2. A method for installing tongue-and-groove material as recited in claim 1, wherein the securing member is a nail passing through the hole in the lever and driven into the installation surface, thereby substantially non-pivotably securing the lever to the installation surface.

3. A method for installing tongue-and-groove material as recited in claim 1, wherein the thrust portion of the lever is provided with a groove thereon for receiving the tongue of the first piece of tongue-and-groove material.

4. A method for installing tongue-and-groove material, comprising the steps of:

a) placing a first piece of tongue-and-groove material on an installation surface on which the tongue-and-groove material is to be installed adjacent to at least one of a previously installed piece of tongue-and-groove material and a border member;

b) placing a pushing member on the installation surface adjacent to the first piece of tongue-and-groove material;

c) pivotably securing a lever to the installation surface, the lever having a thrust portion and a lever end, so that the pushing member lies between the thrust portion of the lever and the first piece of tongue-and-groove material, and so that rotating the lever urges the pushing member against the first piece of tongue-and-groove material, thereby urging the first piece of tongue-and-groove material against at least one of the previously installed piece of tongue-and-groove material and the border member;

d) rotating the lever, thereby urging the pushing member against the first piece of tongue-and-groove material, thereby urging the first piece of tongue-and-groove material against at least one of the previously installed piece of tongue-and-groove material and the border member;

e) securing the pushing member to the installation surface, thereby continuing to urge the first piece of tongue-and-groove material against at least one of the previously installed piece of tongue-and-groove material and the border member after removing the lever from the installation surface;

f) removing the lever from the installation surface;

g) securing the first piece of tongue-and-groove material to at least one of the previously installed piece of tongue-and-groove material, the border member, and the installation surface; and h) removing the pushing member from the installation surface.

5. A method for installing tongue-and-groove material as recited in claim 4, wherein pushing-member-securing step e) is performed by passing a securing member through a hole through the pushing member and into the installation surface.

6. A method for installing tongue-and-groove material as recited in claim 5, wherein the securing member is a securing nail passing through the pushing member and driven into the installation surface, thereby securing the pushing member to the installation surface.

7. A method for installing tongue-and-groove material as recited in claim 6, wherein:

the lever-securing step c) is performed by driving a pivot nail through a hole through the lever and into the installation surface; and the pushing member is provided with a groove thereon for receiving the tongue of the first piece of tongue-and-groove material.

8. A method for installing tongue-and-groove material as recited in claim 6, wherein:

the thrust portion of the lever is a cam end of the lever;

the lever-securing step c) is performed by driving a pivot nail through a hole through the cam end of the lever and into the installation surface; and the pushing member is provided with a groove thereon for receiving the tongue of the first piece of tongue-and-groove material.

9. An apparatus for installing tongue-and-groove material, comprising a lever having a thrust portion and a lever end, wherein:

the lever is adapted to be pivotably secured to an installation surface on which the tongue-and-groove material is to be installed so that rotating the lever urges a first piece of tongue-and-groove material against at least one of a previously installed piece of tongue-and-groove material and a border member;

the lever is provided with a hole therethrough adapted for receiving a securing member therethrough;

the lever is adapted to be substantially non-pivotably secured to the installation surface by a securing member received through the hole, thereby continuing to urge the first piece of tongue-and-groove material against at least one of the previously installed piece of tongue-and-groove material and the border member; and the lever is adapted to be removed from the installation surface after the first piece of tongue-and-groove material has been secured to at least one of the previously installed piece of tongue-and-groove material, the border member, and the installation surface.

10. An apparatus for installing tongue-and-groove material as recited in claim 9, wherein the lever is adapted to be substantially non-pivotably secured to the installation surface by a nail received through the hole and driven into the installation surface, thereby continuing to urge the first piece of tongue-and-groove material against at least one of the previously installed piece of tongue-and-groove material and the border member.

11. An apparatus for installing tongue-and-groove material as recited in claim 9, wherein the thrust portion of the lever is provided with a groove thereon for receiving the tongue of the first piece of tongue-and-groove material.

12. An apparatus for installing tongue-and-groove material, comprising:

a lever having a thrust portion and a lever end; and a pushing member adapted to be positioned between the thrust portion of the lever and a first piece of tongue-and-groove material, wherein:

the lever is adapted to be pivotably secured to an installation surface on which the tongue-and-groove material is to be installed so that rotating the lever urges the pushing member against the first piece of tongue-and-groove material, thereby urging the first piece of tongue-and-groove material against at least one of a previously installed piece of tongue-and-groove material and a border member;

the pushing member is provided with a hole therethrough so as to be adapted to be secured to the installation surface, thereby continuing to urge the first piece of tongue-and-groove material against at least one of the previously installed piece of tongue-and-groove material and the border member after removing the lever from the installation surface;

the lever is adapted to be removed from the installation surface after the pushing member has been secured to the installation surface; and the pushing member is adapted to be removed from the installation surface after the first piece of tongue-and-groove material has been secured to at least one of the previously installed piece of tongue-and-groove material, the border member, and the installation surface.

13. An apparatus for installing tongue-and-groove material as recited in claim 12, wherein:

the pushing member hole is adapted for receiving a securing member therethrough;

the pushing member is adapted to be secured to the installation surface by a securing member received through the hole, thereby continuing to urge the first piece of tongue-and-groove material against at least one of the previously installed piece of tongue-and-groove material and the border member.

14. An apparatus for installing tongue-and-groove material as recited in claim 13, wherein the pushing member is adapted to be secured to the installation surface by a securing nail received through the hole and driven into the installation surface, thereby continuing to urge the first piece of tongue-and-groove material against at least one of the previously installed piece of tongue-and-groove material and the border member.

15. An apparatus for installing tongue-and-groove material as recited in claim 14, wherein:

the lever has a hole therethrough adapted for receiving a pivot nail therethrough;

the lever is adapted to be pivotably secured to the installation surface by the pivot nail received through the hole in the lever and driven into the installation surface; and the pushing member is provided with a groove thereon for receiving the tongue of the first piece of tongue-and-groove material.

16. An apparatus for installing tongue-and-groove material as recited in claim 14, wherein:

the thrust portion of the lever is a cam end of the lever;

the cam end of the lever has a hole therethrough adapted for receiving a pivot nail therethrough;

the lever is adapted to be pivotably secured to the installation surface by the pivot nail received through the hole in the cam end of the lever and driven into the installation surface; and the pushing member is provided with a groove thereon for receiving the tongue of the first piece of tongue-and-groove material.

* * * * *